US005771664A

United States Patent [19]

Recchia, Jr.

[11] Patent Number: 5,771,664

[45] Date of Patent: Jun. 30, 1998

[54] LABEL FOR BAGS WITH WIRE LOOP CLOSURES

[75] Inventor: Michael J. Recchia, Jr., Roselle, Ill.

[73] Assignee: Tagit Enterprises Corporation, Chicago, Ill.

[21] Appl. No.: 747,282

[22] Filed: Nov. 12, 1996

[51] Int. Cl.[6] ..... B65B 51/04

[52] U.S. Cl. ..... 53/417; 53/419; 53/136.5; 53/138.4; 53/138.7

[58] Field of Search ..... 53/136.5, 138.3, 53/138.4, 138.7, 139.1, 417, 419, 583

[56] References Cited

U.S. PATENT DOCUMENTS

| | | | |
|---|---|---|---|
| 3,354,915 | 11/1967 | Johnson et al. | 53/138.8 X |
| 3,375,634 | 4/1968 | Jarund | 53/417 X |
| 3,386,478 | 6/1968 | Pitkanen | 53/138.8 X |
| 3,483,801 | 12/1969 | Kupcikevicius | 53/134.1 X |
| 3,589,092 | 6/1971 | Jarund | 53/417 X |
| 4,044,450 | 8/1977 | Raudys et al. | 53/417 X |
| 4,165,593 | 8/1979 | Niedecker | 53/417 X |
| 4,176,479 | 12/1979 | Lhoir | 53/417 X |
| 4,324,086 | 4/1982 | Niedecker | 53/138.3 X |
| 4,537,006 | 8/1985 | Pieri | 53/138.3 X |
| 4,660,351 | 4/1987 | Saitoh | 53/138.8 X |
| 4,711,064 | 12/1987 | Tsuda | 53/136.1 |
| 5,067,313 | 11/1991 | Evans | 53/134.1 X |
| 5,269,116 | 12/1993 | Roberts et al. | 53/138.4 |

*Primary Examiner*—Daniel Moon
*Attorney, Agent, or Firm*—Gerstman, Ellis & McMillin, Ltd.

[57] ABSTRACT

A supplemental label may be attached to a bag having a wire loop closure by the steps of: forming a bag neck of a filled, flexible bag by collapsing bag material about the mouth of the bag. The filled, flexible bag is advanced along a process line to a wire loop closure applying station. An elongated neck of a label is placed against the bag neck, and the wire loop closure is applied tightly around the bag neck and the elongated label neck to close the bag, and to simultaneously attach the label to the bag by wire loop closure attachment. The labels may be fed to the system in strip form. Also, they may be printed after being unwound from a storage roller assembly and before being applied to the bag.

10 Claims, 2 Drawing Sheets

LABEL FOR BAGS WITH WIRE LOOP CLOSURES

BACKGROUND OF THE INVENTION

Produce, such as potatoes, apples, and onions, is often delivered to the retail user in a plastic bag with an open top. The open top is bunched together and closed with a wire loop, commonly called a hog ring in the field of packaged produce.

Hog rings are commercially used to close produce and other bags on many automated assembly lines, using, for example, a Hammer model 125 wire ring application machine, sold by the Hammer Manufacturing Company of Minneapolis, Minn. With such a machine, a flexible bag filled with produce is advanced along a process line, where a bag neck is automatically formed by collapsing bag material about the mouth of the bag. Then, at a wire ring closure applying station, a wire loop closure is applied tightly around the bag neck, to close the bag.

A recent, perceived disadvantage has arisen with respect to wire loop bag closures, when compared with certain other bag closure techniques, such as heat sealing, plastic tabs, and the like. Recent techniques are capable of applying printed text to the bag, or a paper or cardboard attachment thereto, with this printed attachment being applied to the bag at the time of sealing. Advertising and promotional material may thus be placed on the bag, and the contents of the bag may be identified in the same manner, so that it may not be necessary to provide printing on the surface of the bag itself.

By this invention, an improved ring closure for a bag is provided, which may also carry a label on which desired information or promotional material may be printed. Thus the advantages of a ring closure may be retained while a label is also provided. This may be used for bags holding produce, ice, or any desired product.

DESCRIPTION OF THE INVENTION

By this invention a flexible bag is provided, having a wall with one permanently sealed end, such as a sealed end in plastic bags, and one openable end defining a mouth, generally a conventional, open mouth bag end. The walls of the bag adjacent the openable end are bunched to form a bag neck. A label is provided having an elongated neck, like a conventional wine glass label, with the neck of the label lying against the bag neck. A looped wire closure is applied, to tightly surround the bag neck and the label neck to close the bag and to attach the label and the bag.

This label is easily incorporated into an automated closure ring applying machine such as the previously described Hammer model 125 machine, with the labels coming from a strip of labels wound as a roll, so that they may be continuously applied to bags along with the looped wire closure or hog ring in an automated, continuous-production manner.

This may be accomplished by forming a bag neck of a filled, flexible bag by collapsing bag material about the mouth of the bag; and advancing the filled, flexible bag along a process line to a wire ring closure applying station. One places an elongated neck of the label or tag of this invention against the bag neck, followed by applying a wire loop closure tightly around the bag neck and the elongated label neck, to close the bag and to simultaneously attach the label to the bag by the wire loop closure attachment.

As stated, the label preferably comprises one of a strip of labels which are attached together by lines of tearing weakness. The labels of the strip are advanced to be sequentially placed against sequential bag necks as the bags are advanced along the process line.

Rollers may be used to advance a strip of labels by the length of a single label, to sequentially place the elongated label neck against a bag neck. This may be controlled by an electric eye, making use of labels which have a transversely-enlarged portion integral with the elongated neck. Basically, the transversely-enlarged label portion can block the electric eye while the neck portion does not, so that the machine can precisely determine the position of the label in the strip.

After the bag is closed with the wire ring closure, it may be advanced again along the process line, while the label is torn away from the strip after its attachment to the bag neck.

Additionally, a printer can be provided to print indicia on the strip of labels after the labels have been unrolled from a roll, but before the labels are placed against a bag neck. Thus, the latest pricing, promotion, or other information can be provided as the bags are being closed. Also, the bags can be filled with different products, which may then be simultaneously identified by instructions sent to the printer for the label or tag of this invention as the bags are closed.

Thus, the reliability and simplicity of the wire loop or hog ring closure for flexible bags may be supplemented by a label or tag which is also attached by the ring closure, on which desired labeling, pricing or other information may be placed without loss of automated assembly capability.

DESCRIPTION OF SPECIFIC EMBODIMENTS

Figure 1:
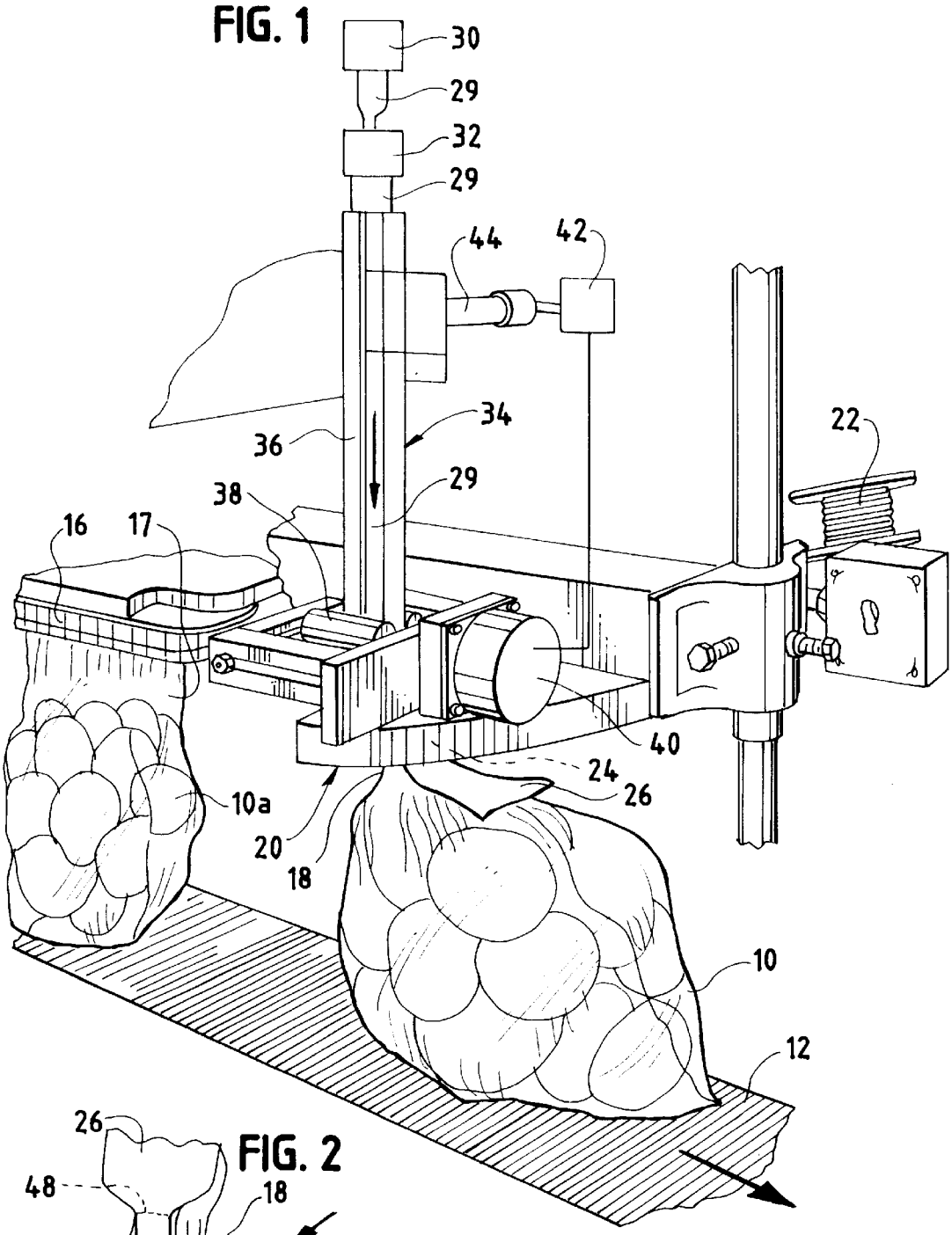
FIG. 1 is a partially schematic, perspective view of part of an assembly line for closing and labeling bags filled with produce, in accordance with this invention.

Referring to FIG. 1, an apparatus for bagging produce with a wire ring closure and for applying an attached label is disclosed in accordance with this invention.

Bags of produce 10, 10*a* are advanced along a process path defined by a conveyor belt 12 after having been filled with their contents, for example potatoes, ice, onions, or any other desired contents. As shown, and as conventional in commercial process machinery for the purpose, bags 10, 10*a* move on belt 12 along with chain loop 16, which, in turn, advances the tops 17 of the bags, held in flat form, along with the bags themselves on conveyor belt 12. The bags are freshly formed from strips of plastic, and are separated by cutting as they come to ring closure applying station 20. At ring closure applying station 20, the bag top 17 is conventionally grasped and bunched to form a neck 18 of bag material at the top of the bag.

Figure 4:
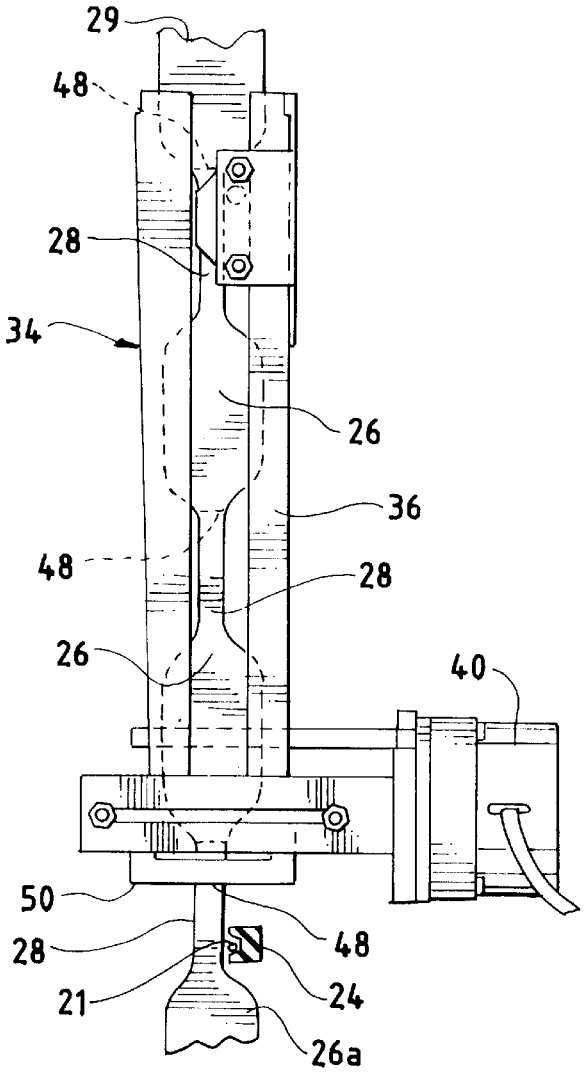
FIG. 4 is an elevational view taken 90° from the view of FIG. 3.
Figure 5:
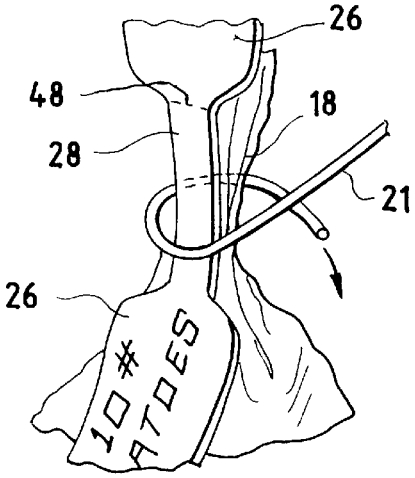
FIG. 5 shows a further step of the application of the wire loop in the process initially shown in FIG. 2.
Figure 6:
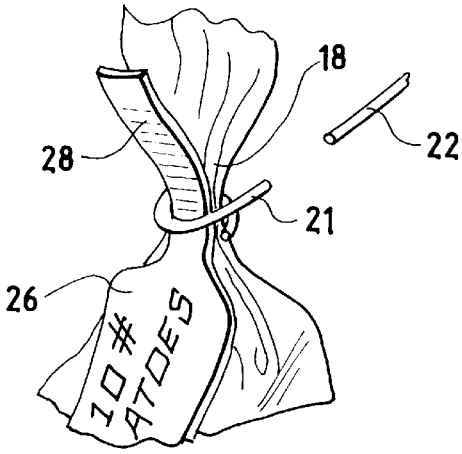
FIG. 6 shows a third step of the wire loop closure process.

Station 20 may be conventional, apart from the modifications of this invention. There, wire from a storage spool 22 is pressed by a conventional die 24 (FIG. 4) into a loop around bag neck 18, as particularly shown in FIGS. 2–6, to form a wire closure loop. Label or tag 26 has a narrow neck portion 28, which is secured to bag neck 18 by the loop of wire 21 applied at closure application station 20. The wire is conventionally cut, as shown in FIG. 6, and the main, uncut length of wire 22 is further advanced for wrapping another length of wire 21 around another neck of the advancing bag 10*a*.

The dies used in the conventional wire loop formation and application process are rather similar in function to a large stapler, with the moving dies 24 bending and shaping the length of wire 21 into a desired, tight loop around bag neck 18.

Label 26 is applied to its position where it is captured by wire loop 21 against bag neck 18 by the apparatus shown. Labels 26 are initially in strip form as particularly shown in FIG. 4, with the strip 29 being provided in a roll 30 to the apparatus. If desired, a printer unit 32 may be provided to print any desired indicia on the various labels 26 of the strip, so that prices, advertising information, and product identification may vary without the need for a change in set up of the machine. A line of tearing weakness 48 such as perforations is provided between individual labels 26.

Label strip 29 passes through a conventional strip guide 34, which may comprise a metal sheet having edges 36 folded over to provide an internal, guided track for strip 29.

Figure 2:
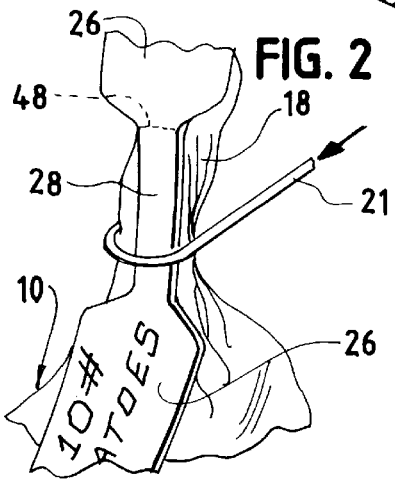
FIG. 2 is a detailed, perspective view of part of the bag closing process, with parts removed for simplicity of disclosure.
Figure 3:
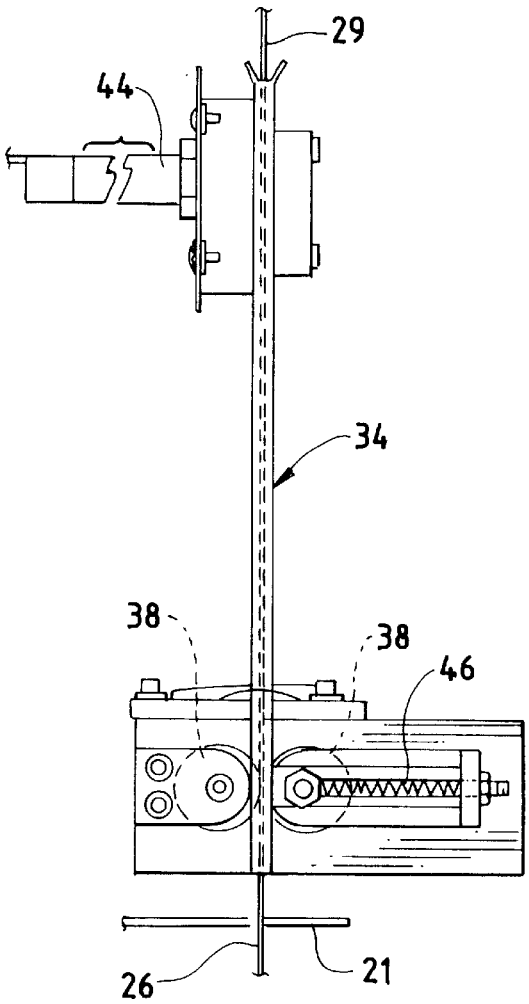
FIG. 3 is an elevational view of the label or tag applying apparatus, used as part of the process of bag closure.

Strip 29 is advanced by advancing rollers 38, which press together to frictionally advance strip 29 as desired, being powered by electric motor 40. Motor 40, in turn, is controlled by a switching system 42, electronic or otherwise, which turns motor 40 on and off to advance strip 29 intermittently as labels are needed by the process. The degree of advancement of strip 29 can be controlled by photoelectric device 44, which is set to detect the passage of the wider strip portions 26, but to not detect passage of elongated, narrower neck portions 28. Thus, a change in photoelectric response can be correlated with a desired position of the lowermost strip 26*a* (FIG. 4) for proper positioning to be surrounded by wire 21 during the wire loop closure application process as shown in FIGS. 2, 5 and 6.

One roller 38 may be mounted on a pressure spring 46 to provide a desired amount of tension for frictional advancement. Strip roll 30 may also be mounted on a tension roller, having a desired amount of tension set to keep a gentle tension on the strip without sufficient tension to cause breakage of the respective lines of tearing weakness 48 in the strip.

Thus, motor 40 and rollers 38 cause strip 29 to be advanced by an exact amount of the length of a label 26, preferably to the point where perforations defining the line of tearing weakness 48 of the lowermost label 26*a* (FIG. 4) are flush with the bottom of the apparatus framework 50. Wire loop closure die 24 then causes advancing wire to move around the neck 18 of the bag in a manner of steps illustrated by FIGS. 2, 5 and 6. The loop wire of 21 is tightened to form the desired hog ring or closure ring, and the wire is cut. Since elongated neck 28 of label 26 lies next to bag neck 18, it is also surrounded by wire 21 and tightly secured to the bag neck. Thus, label 26 is reliably carried with the bag, providing the desired information.

Bag 10 then proceeds on its way, carried by moving belt 12, causing line of tearing weakness 48 to be severed at the upper end of elongated neck 28.

Thus, an automated, continuous process is provided by which open bags of produce or the like may be closed and sealed with a wire ring, with a label or tag attached to the bag neck by the same ring.

The above has been offered for illustrative purposes only, and is not intended to limit the scope of the invention of this application, which is defined in the claims below.

That which is claimed is:

1. The method of attaching a supplemental label to a bag having a wire loop closure, which comprises:

forming a bag neck of a filled, flexible bag, by collapsing bag material about a mouth of the bag;

advancing a strip of labels attached together by lines of tearing weakness to place an elongated neck of a label against the bag neck, with the labels of the strip being advanced to be sequentially placed against sequential bag necks of bags advancing along a process line, in which rollers advance said strip of labels by a length of a single label with each placement of an elongated label neck against a bag neck, each said label comprising a transversely-enlarged portion integral with said elongated neck;

applying a wire loop closure tightly around the bag neck and the elongated label neck to close the bag and to simultaneously attach the label to the bag by wire loop closure attachment;

and tearing away said label from said strip after attachment to the bag neck by further movement of the bag along the process line.

2. The method of claim 1 in which a printer prints indicia on said strip of labels before said labels are placed against a bag neck.

3. The method of claim 1 in which the label is placed against the bag neck with the transversely-enlarged label portion being more remote from the bag mouth than the label neck.

4. The method of attaching supplemental labels to bags having wire loop closures, which method comprises:

advancing filled, flexible bags sequentially along a process line;

sequentially forming bag necks in the bags by collapsing bag material about a mouth of each bag;

placing an elongated neck of a label against said bag neck, said label comprising one of a strip of labels attached together by lines of tearing weakness, by sequentially advancing the labels of the strip to be sequentially placed against sequential bag necks of bags advancing along the process line by advancing the strip of labels with rollers each time by a length of a single label, for each placement of an elongated label neck against each bag neck;

applying a wire loop closure tightly around the bag neck and the elongated label neck to close the bag and to simultaneously attach the label to the bag by wire loop closure attachment; and tearing each label sequentially away from said strip after attachment to its bag neck by further movement of the bag along the process line.

5. The method of claim 4 in which each label is placed against the bag neck with a transversely-enlarged label portion being more remote from the bag mouth than the label neck.

6. The method of claim 4 in which said label strip advancing rollers are controlled by sensing apparatus comprising an electric eye for sensing the advancement of said strip by said rollers, to control said advancement so that each advancement of said strip places an elongated label neck against each bag neck.

7. The method of claim 4 in which each label comprises a transversely-enlarged portion integral with said elongated neck.

8. The method of claim 7 in which each label is placed against the bag neck with the transversely-enlarged label portion being more remote from the bag mouth than the label neck.

9. The method of claim 7 in which a printer prints indicia on said strip of labels before said labels are placed against a bag neck.

10. The method of claim 7 in which said label strip advancing rollers are controlled by sensing apparatus comprising an electric eye for sensing the advancement of said strip by said rollers, to control said advancement so that each advancement of said strip places an elongated label neck against each bag neck.

* * * * *